US005533290A

United States Patent [19]

Lee et al.

[11] Patent Number: 5,533,290

[45] Date of Patent: * Jul. 9, 1996

[54] PICTURE FRAME WITH SOUND PRODUCING MEANS

[76] Inventors: Tong Y. Lee; Jack Kao, both of 8F-6, No.100, Sec.2, Hoping E. Rd., Taipei, Taiwan

[ * ] Notice: The term of this patent shall not extend beyond the expiration date of Pat. No. 5,513,454.

[21] Appl. No.: 158,440

[22] Filed: Nov. 29, 1993

[51] Int. Cl.[6] ..... G09F 1/12

[52] U.S. Cl. ..... 40/717; 40/455

[58] Field of Search ..... 40/152, 152.1, 40/455, 124.1, 906, 717; 369/63, 64, 69, 70

[56] References Cited

U.S. PATENT DOCUMENTS 5,182,872 2/1993 Lee et al. ..... 40/455 X
5,359,374 10/1994 Schwartz ..... 40/152.1 X

FOREIGN PATENT DOCUMENTS 6133838 5/1994 Japan ..... 40/152
9428529 12/1994 WIPO ..... 40/152.1

*Primary Examiner*—Brian K. Green
*Attorney, Agent, or Firm*—Browdy and Neimark

[57] ABSTRACT

A picture frame includes a frame body fastened with an open mounting frame to hold a glass and a picture, a back cover covered on the open mounting frame, a mounting plate covered on the back cover and retained between the back cover and the open mounting frame, a back board supported on springs on the mounting plate and having two electrically connected metal contact strips, and a sound generating circuit assembly installed in the back cover and having two opposite terminals connected to metal contact pins on the mounting plate, wherein when the glass is pressed against the back board to compress the springs, the metal contact pins become electrically connected by the metal contact strips causing the sound producing circuit assembly triggered to produce sound.

3 Claims, 4 Drawing Sheets

PICTURE FRAME WITH SOUND PRODUCING MEANS

BACKGROUND OF THE INVENTION

The present invention relates to a picture frame having sound producing means, and more particularly relates to a touch control switch for a picture frame for controlling the operation of a sound producing circuit assembly being installed in the picture frame.

A normal picture frame is simply a standing ornamental frame for holding a picture. Because it is a standing object, it is monotonous and less attractive. The present invention provides a picture frame with a sound generating circuit assembly so that the picture frame gives sound when it is touched. The present invention also provides a touch control circuit which controls the operation of the sound generating circuit assembly. According to the preferred embodiment of the present invention, the sound generating circuit assembly is fastened inside the back cover of the picture frame with its two opposite terminals respectively connected to two opposite metal contact pins. The metal contact pins are electrically connected by metal contact strips on the back board of the picture frame as the glass of the picture frame is pressed, and therefore the sound generating circuit assembly is triggered to produce sound.

DETAILED DESCRIPTION OF THE PREFERRED EMBODIMENT

Figure 1:
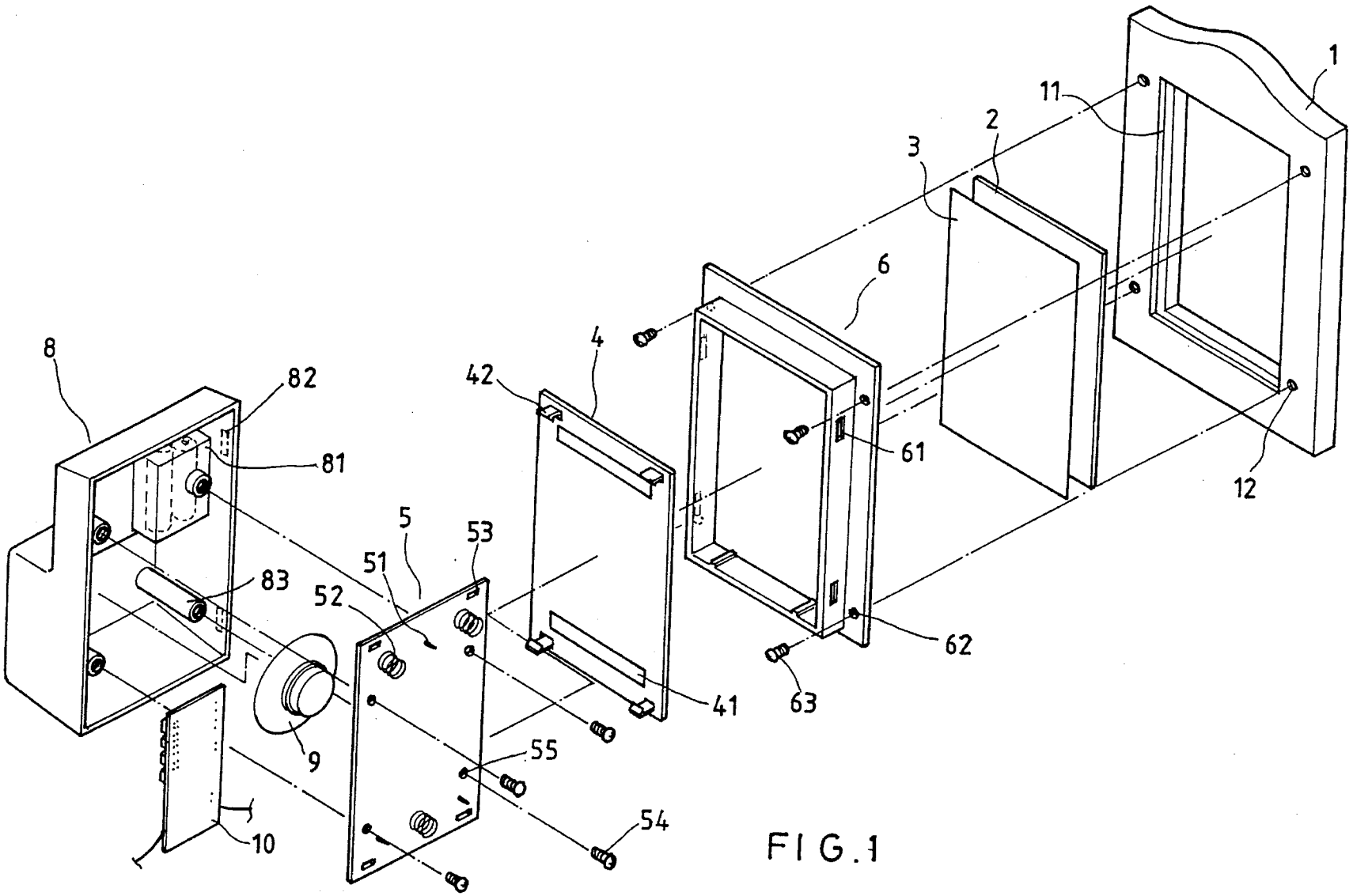
FIG. 1 is an exploded view of a picture frame according to the preferred embodiment of the present invention.
Figure 2:
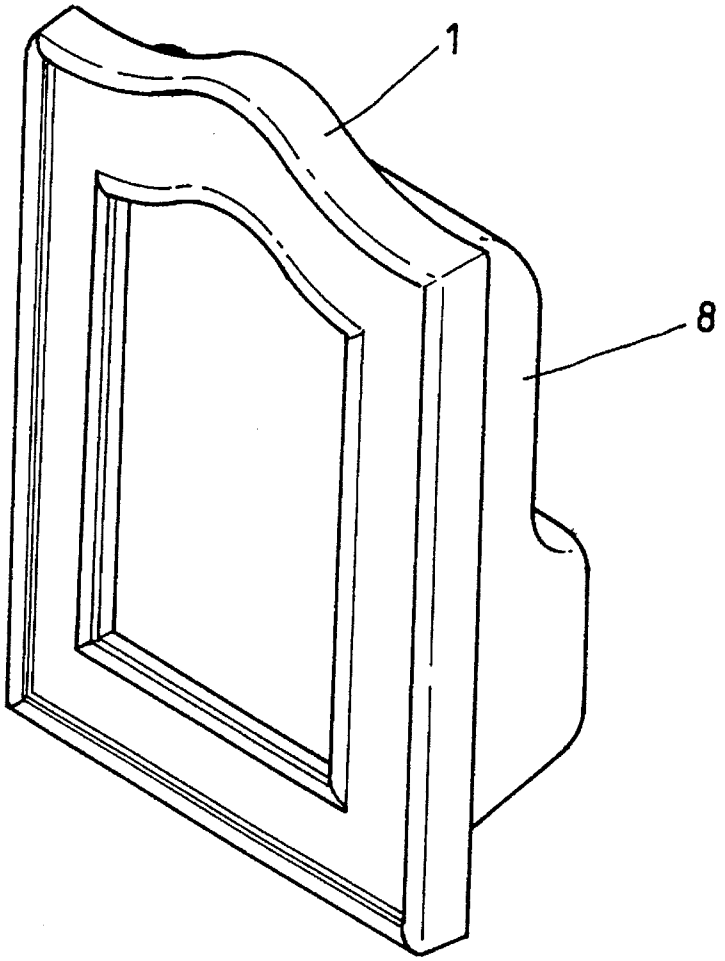
FIG. 2 is an elevational view of the picture frame of FIG. 1.
Figure 3:
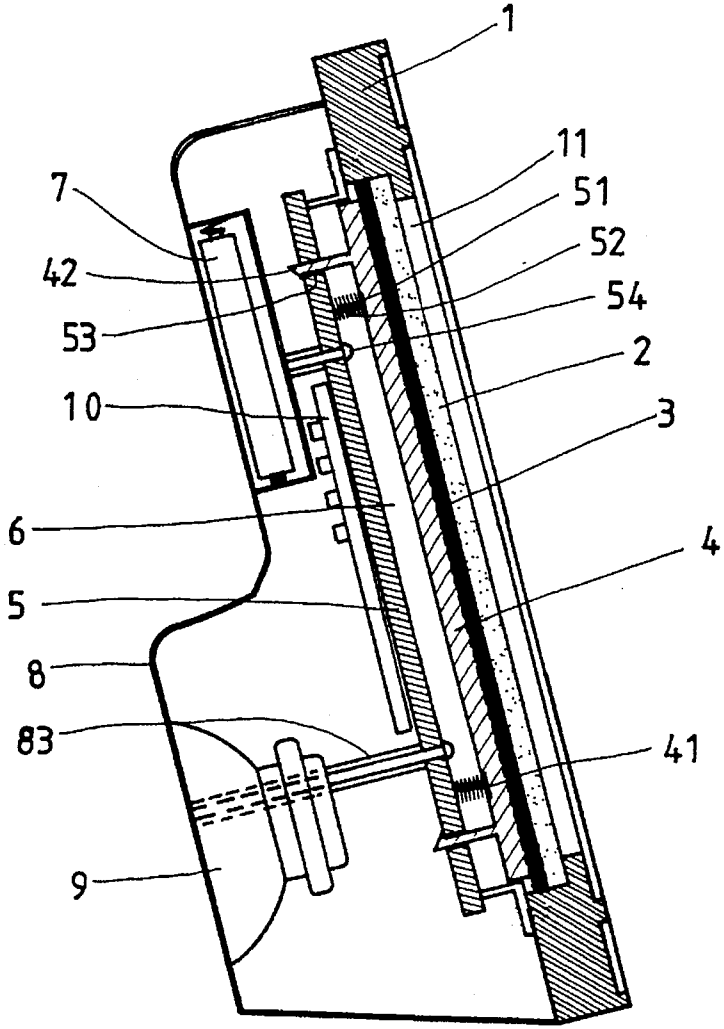
FIG. 3 is a sectional view of the picture frame of FIG. 1 showing the circuit thereof opened.

Referring to FIG. 1, 2, and 3, a picture frame in accordance with the present invention is generally comprised of a frame body 1, a glass 2, a picture 3, a back board 4, a mounting plate 5, an open mounting frame 6, a battery set 7, a back cover 8, a speaker 9, and a sound generating circuit assembly 10. The frame body 1 is made of an open frame having a stepped picture mounting hole 11 in the center, which receives the glass 2 and the picture 3, and a plurality of screw holes 12 spaced around the stepped picture mounting hole 11. The open mounting frame 6 is fastened to the frame body 1 to retain the glass 2 and the picture 3 within the picture mounting hole 11 on the frame body 1 by threading screws 63 through respective screw holes 62 on the open mounting frame 6 into the screw holes 12 on the frame body 1 respectively. The open mounting frame 6 further comprises a plurality of back cover mounting holes 61 horizontally spaced around four sides thereof at a different elevation (relative to the screw holes 62 thereof) for mounting the back cover 8. The back cover 8 comprises a battery box 81, which receives the battery set 7, a plurality of horizontal projecting blocks 82 spaced around the inside wall thereof at locations corresponding to the horizontal back cover mounting holes 61, and a plurality of female screws 83 spaced on the inside around the four corners thereof. The mounting plate 5 comprises a plurality of screw holes 55 corresponding to the female screws 83 on the back cover 8, a plurality of retaining holes 53 spaced around the four corners thereof, opposite contact pins 51 disposed at two opposite locations, and a plurality of springs 52 raised from the back side thereof. The back board 4 comprises a plurality of hooks 42 at locations corresponding to the retaining holes 53 on the mounting plate 5, and two opposite metal contact strips 41 electrically connected together. The speaker 9 and the sound generating circuit assembly 10 are fastened within the back cover 8. After the speaker 9 and the sound generating circuit assembly 10 are installed in the back cover 8, the mounting plate 5 is fastened to the back cover 8 by threading screws 55 through the screw holes 55 on the mounting plate 5 into the female screws 83 on the back cover 8, and therefore the speaker 9 and the sound generating circuit assembly 10 are covered within the back cover 8 by the mounting plate 5. Then, the back board 4 is fastened to the mounting plate 5 by hooking the hooks 42 into the retaining holes 53 respectively permitting the back board 4 to be supported on the springs 52. When fastened, the opposite contact pins 51 respectively face the opposite metal contact strips 41 on the back board 4. Because of the effect of the springs 52, the opposite contact pins 51 are stopped from touching the opposite metal contact strips 41. Finally, the open mounting frame 6 is fastened to the back cover 8 by inserting the projecting blocks 82 into the back cover mounting holes 61. When the whole assembly is assembled, the metal contact strips 41, the contact pins 51, the speaker 9, the sound generating circuit assembly 10, and the battery set 7 are connected into a normal open circuit.

Figure 4:
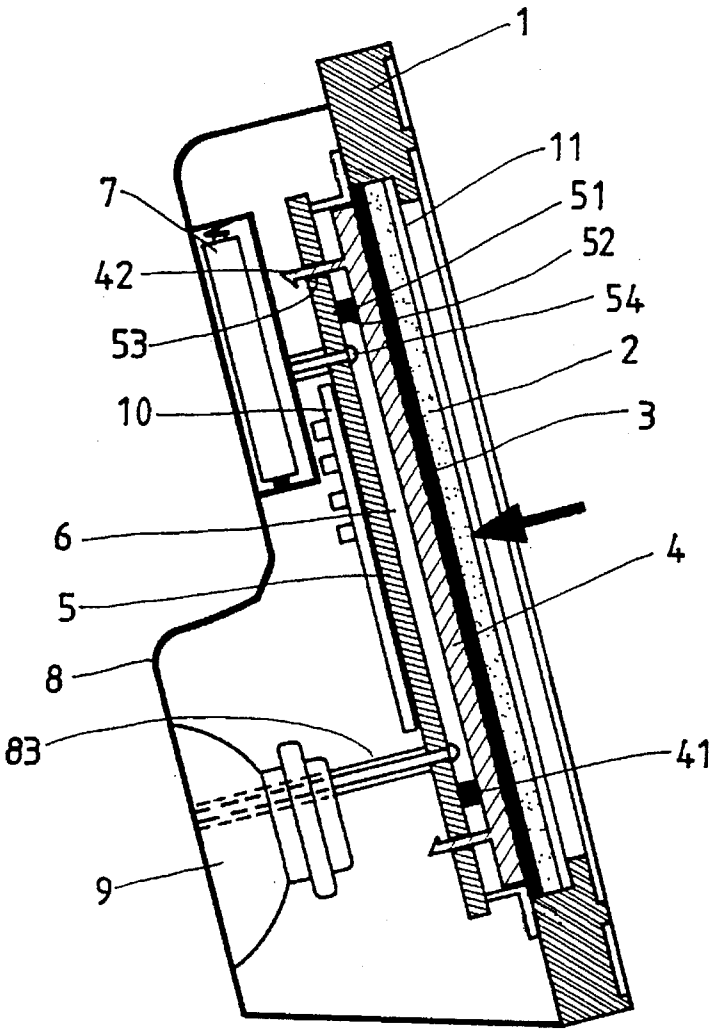
FIG. 4 is similar to FIG. 3 but showing the circuit thereof closed.
Figure 5:
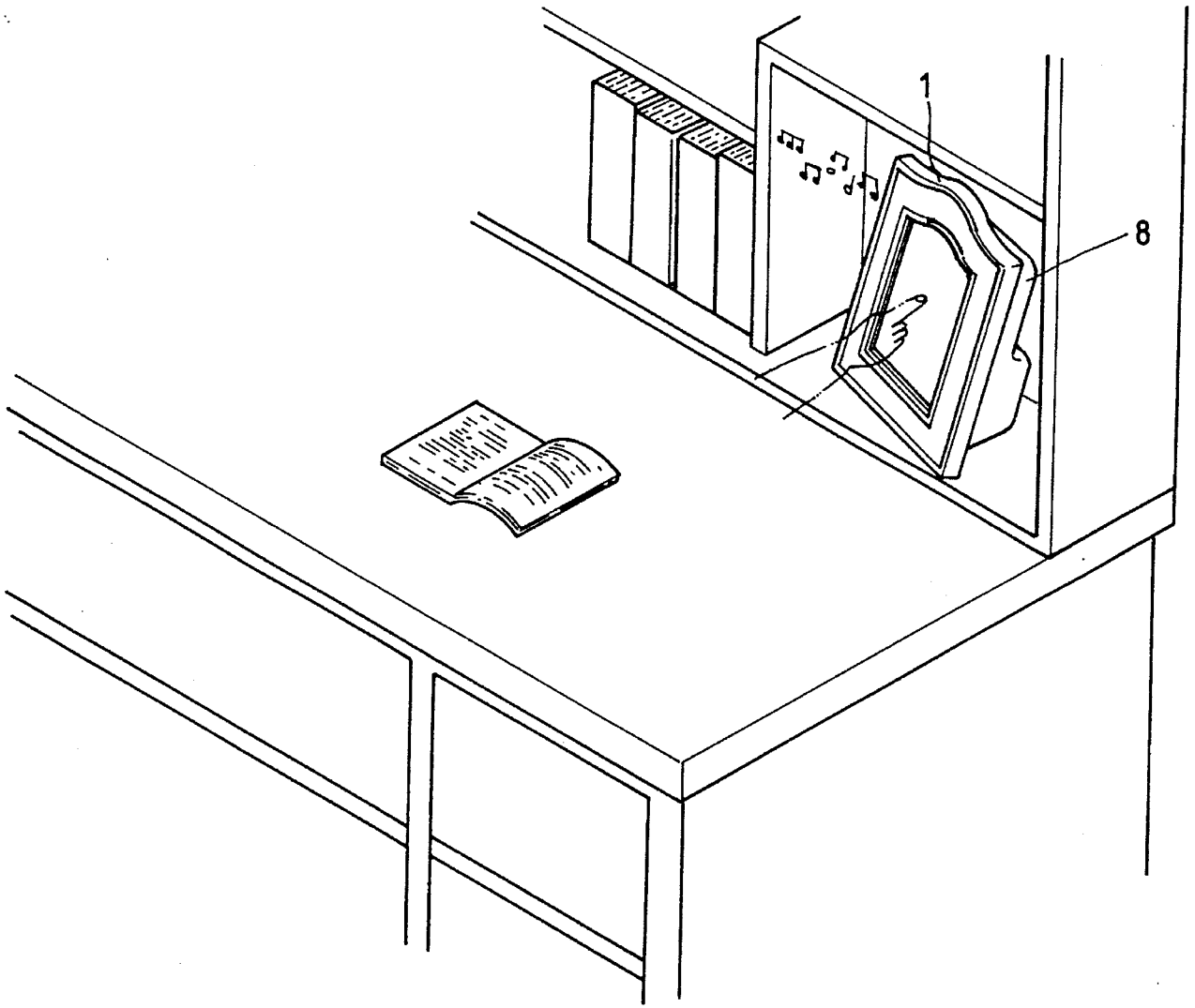
FIG. 5 shows the picture frame of FIG. 1 touched to sound.

Referring to FIGS. 4 and 5, when the glass 2 is pressed with the hand, the springs 52 are compressed, causing the metal contact strips 41 to contact the contact pins 51 respectively, and therefore the circuit is closed. As the circuit is closed, the sound generating circuit assembly 10 is triggered to produce sound. The sound generating circuit assembly 10 may be variously embodied. For example, it may comprise a speech recording mechanism to record a speech such as "How are your?", "I miss you so much!", etc., for reproduction upon being triggered. The sound generating circuit assembly 10 may also be so made that it gives the correct time when triggered.

What is claimed is:

1. A picture frame comprising:

a frame body made of an open frame having a glass mounted within a stepped picture mounting hole thereof;

an open mounting frame fastened to said frame body to hold said glass within said frame body;

a back cover fastened to said open mounting frame to hold a picture on said glass;

said back cover engaged over a mounting plate, said mounting plate retained between said back cover and said open mounting frame, said mounting plate comprising two opposite metal contact pins and a plurality of spring elements projecting from a back side thereof;

a back board slidably engaged in said open mounting frame and retained between said mounting plate and said open mounting fame and engaging said spring elements, said back board comprising two opposite metal contact strips connected together by an electric wire;

a sound producing circuit assembly comprised of a battery power supply and a speaker and fastened inside said back cover, said sound producing circuit assembly having two opposite terminals respectively connected to said two opposite metal contact pins of said mounting plate;

wherein when said glass is pressed toward said back board, said back board is forced to compress said spring elements causing said metal contact strips to contact said metal contact pins, thereby triggering said sound producing circuit assembly to produce sound.

2. The picture frame of claim 1 wherein said open mounting frame comprises a plurality of retaining holes spaced around four sides thereof, and said back cover comprises a plurality of projecting blocks spaced around an inside wall thereof and respectively fitted into said retaining holes on said open mounting frame.

3. A picture frame comprising:

a frame body having an opening;

a glass mounted within said opening;

an open mounting frame fastened to said frame body to hold said glass within the frame body;

a back cover fastened to said open mounting frame to hold a picture on said glass;

a mounting plate attached to said back cover and retained between said back cover and said open mounting frame, said mounting plate comprising two opposite metal contacts and a plurality of spring elements projecting from a back side thereof;

a back board attached to said open mounting frame and retained between said mounting plate and said open mounting frame and engaging said spring elements, said back board comprising conductive means;

a sound producing circuit assembly comprised of a battery power supply and a speaker and fastened inside said back cover, said sound producing circuit assembly having two opposite terminals respectively connected to said two opposite metal contacts of said mounting plate; and wherein when said glass is pressed toward said back board, said back board is forced to compress said elements causing said conductive means to contact said metal contacts, and therefore said sound producing circuit assembly is triggered to produce sound.

* * * * *